United States Patent [19]

Rich

[11] Patent Number: 4,714,644

[45] Date of Patent: Dec. 22, 1987

[54] SANDING PAD

[75] Inventor: Larry D. Rich, Oakdale, Minn.

[73] Assignee: Minnesota Mining and Manufacturing Company, St. Paul, Minn.

[21] Appl. No.: 947,695

[22] Filed: Dec. 30, 1986

[51] Int. Cl.[4] ..... B24D 11/00; B32B 3/10; B32B 5/18

[52] U.S. Cl. ..... 428/136; 51/401; 51/407; 428/138; 428/143; 428/323

[58] Field of Search ..... 51/393, 401, 402, 407; 428/136, 137, 138, 141, 155, 143, 144, 317.1, 317.7, 323

[56] References Cited

U.S. PATENT DOCUMENTS

| | | | |
|---|---|---|---|
| 3,021,649 | 2/1962 | Robbins | 428/137 |
| 4,202,139 | 5/1980 | Hong et al. | 51/393 |
| 4,459,987 | 7/1984 | Pangburn | 51/401 |

*Primary Examiner*—William J. Van Balen
*Attorney, Agent, or Firm*—Donald M. Sell; James A. Smith; William L. Huebsch

[57] ABSTRACT

A sanding pad particularly useful for simultaneously intersecting surfaces that form sanding inside or outside corners. The pad comprises a stiff rectangular backing sheet having through slits along closely spaced parallel lines, with the slits along each line forming most of the line and being spaced by a plurality of unslit parts of the sheet. A coating of abrasive granules is adhered along a first surface of the sheet, and a layer of resiliently compressible foam is adhered on and coextensive with a second surface of the backing sheet which affords bending the backing sheet at about a right angle along one of the lines to deform the foam adjacent the line about which said sheet is bent while retaining in generally planar condition the two portions of the sheet on opposite sides of the line about which the sheet is bent.

6 Claims, 3 Drawing Figures

SANDING PAD

TECHNICAL FIELD

The present invention relates to sanding pads of the type having a layer of abrasive coated on a backing structure that has sufficient body and flexibility to facilitate handling and conforming the pad during its use to manually sand a surface.

BACKGROUND ART

Sanding pads are known which include a layer of abrasive coated on a backing structure that has sufficient body and flexibility to facilitate handling and conforming the pad during its use to manually sand a surface. One such pad comprises a foam backing layer having abrasive granules adhered directly on one major surface, and another comprises a foam backing layer having cloth layer on one major surface and a coating of abrasive granules over the cloth layer. Such sanding pads are used to sand planar or contoured surfaces, and can be bent to help them conform to contour surfaces. When such a pad is used to simultaneously sand intersecting planar surfaces that form an inside corner (e.g., such as in a wooden cabinet) by bending the sanding pad so that two portions thereof are disposed generally at a right angle with the abrasive on their outer surfaces and manually rubbing those outer surfaces along the intersecting surfaces defining the corner, however, the outer surface of the pad on which the abrasive is coated forms a radius between the two portions into which the pad is bent so that the abrasive coating can not reach fully into the inside corner. Also, when such a pad is used to sand two intersecting planar surfaces that form an outside corner, the radius formed by bending the pad to conform to those intersecting surfaces will tend to remove too much material along the edge defined by the surfaces so that such a pad is also not useful for that purpose.

DISCLOSURE OF INVENTION

The present invention provides a sanding pad that can be used to simultaneously sand both intersecting surfaces forming an inside or an outside corner and will reach entirely into the inside corner or will not tend to remove too much material from an edge along the outside corner.

According to the present invention there is provided a sanding pad comprising a stiff rectangular backing sheet having through slits along at least one, and preferably along a plurality of closely spaced parallel lines, with the slits along each line forming most of the line and being spaced by a plurality of unslit parts of the sheet. A coating of abrasive granules is adhered along a first surface of the sheet, and a layer of resiliently compressible foam is adhered on and coextensive with a second surface of the backing sheet. The foam is of sufficiently low density to afford bending the backing sheet at about or even less that a right angle along one of the lines to deform (i.e., compress or stretch) the foam adjacent the line about which said sheet is bent while retaining in generally planar condition the two portions of the sheet on opposite sides of the line about which the sheet is bent. Thus the pad is particularly useful for simultaneously abrading planar surfaces forming inside or outside corners, such as corners of a metal or wooden cabinet.

Additionally, the pad can be conformed to many other surfaces configurations including planar and arcuate parts, and can be rolled into a generally cylindrical configuration for use in abrading inner cylindrical surfaces.

Preferably, the lines in the sanding pad are spaced about 0.48 centimeter (0.19 inch) apart, each of the slits is about 1.9 centimeters (0.75 inch) long, and the parts of the sheet separating the slits along each of the lines are about 0.33 centimeter (0.13 inch) in length along the lines.

Also, preferably, the backing sheet is of cloth to facilitate cleaning the sanding pad, and the foam is an open cell polyurethane foam having a density of about 24 kilograms per cubic meter (1.5 pounds per cubic foot) so that it can be easily compressed or stretched when the pad is bent at right angles, and can also be used to remove contaminants from a surface or used to apply liquid coatings such as paint or stain.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
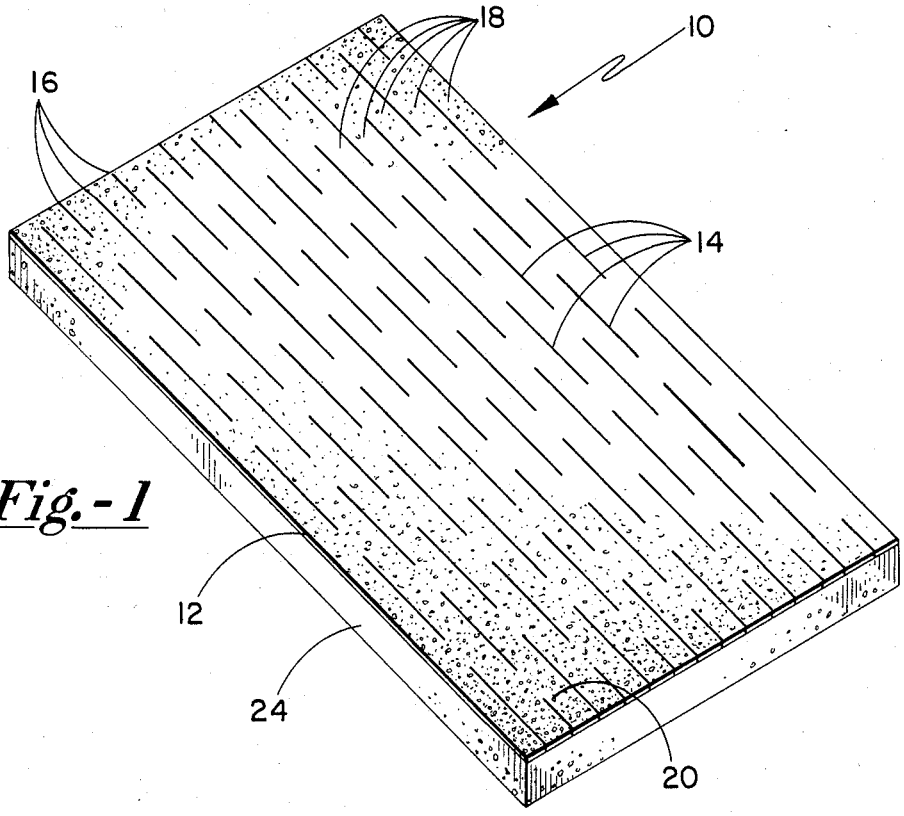
FIG. 1 is a perspective view of a sanding pad according to the present invention.
Figure 2:
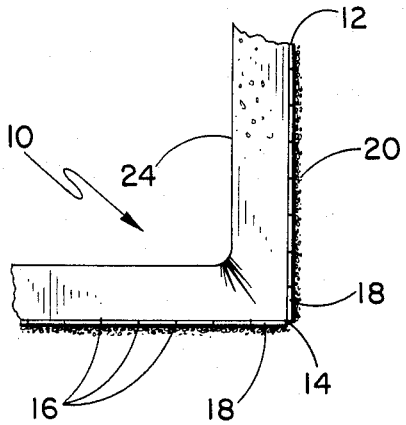
FIG. 2 is an end view of the sanding pad of FIG. 1 showing portions of the pad bent at about a right angle with respect to each other to form an outer abrasive surface suitable for abrading an inner corner.
Figure 3:
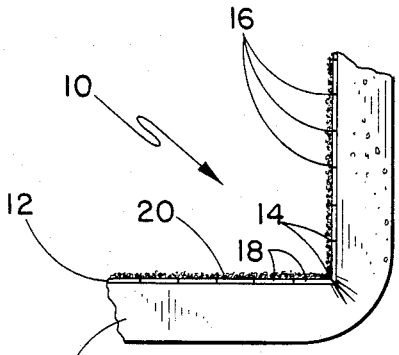
FIG. 3 is an end view of the sanding pad of FIG. 1 showing portions of the pad bent at about a right angle with respect to each other to form an inner abrasive surface suitable for abrading an outer corner.

Referring now to the drawing there is shown a sanding pad according to the present invention that is generally designated by the reference numeral 10. The pad 10 comprises a stiff rectangular backing sheet 12 having through slits 14 along closely spaced parallel lines 16, with the slits 14 along each line 16 forming most of the line 16 (i.e., at least about 75% and preferably over 80% of each line 16) and being spaced by a plurality of unslit parts 18 of the sheet 12. A coating 20 of abrasive granules (e.g., grade 80, 120, 180 or 220 granules) is adhered along a first surface of the sheet 12, and a layer 24 of resiliently compressible foam is adhered on and coextensive with a second opposite surface of the backing sheet 12. The layer 24 of foam is of sufficiently low density to afford bending the backing sheet 12 at about or even less that a right angle along one of the lines 16 to compress or stretch the layer 24 of foam adjacent the line 16 about which the sheet 12 is bent (depending on whether the sheet 12 is bent so that the coating 20 of granules forms an outer abrasive surface as shown in FIG. 2 or is bent so that the coating 20 of granules forms an inner abrasive surface as shown in FIG. 3) while retaining in generally planar condition the two portions of the sheet 12 on opposite sides of the line 16 about which the sheet 12 is bent. Thus the pad 10 is particularly useful for sanding inside or outside corners formed by the intersection of planar surfaces, such as corners of a wooden or metal cabinet because of the planar condition of the two portions of the sheet which allow those portions of the sheet to reach entirely into the inside corner (FIG. 2) or conform to the planar surfaces forming the outside surface without deforming the edge formed at their intersection (FIG. 3).

Preferably, the backing sheet 12 is of stiff cloth to facilitate cleaning the sanding pad 10 (e.g., the backing sheet and its layer of abrasive granules being formed from a sheet of 3M-ITE Resin Bond Cloth, Type FR, X weight cloth backing abrasive material available from Minnesota Mining and Manufacturing Company, St. Paul, Minn.), and the layer 24 of foam is an about 0.95 centimeter (⅜ inch) thick layer of an open cell polyurethane foam having a density of about 24 kilograms per cubic meter (1.5 pounds per cubic foot) (e.g., the foam commercially designated Type E-170/G available from Illbruck, USA, Inc., Minneapolis, Minn.) so that it can be easily bent at right angles. Preferably, that polyurethane foam is adhered to the sheet with the adhesive commercially designated "Fastbond Foam Adhesive Type 45 NF" available from Minnesota Mining and Manufacturing Company, St. Paul, Minn. Such abrasive is very uniform so that a desired finish can reliably be obtained, will not easily shell from the backing and is a high quality product that can be used to abrade any surface such as that of metal, rusted metal or wood; whereas such a foam will not only deform easily when the pad is bent, but also restricts pressure points that can be caused by the fingers of a person manipulating the pad, is effective for wiping dirt and sanding dust off of a surface, and can be used effectively to apply stain or paint on surfaces.

Also, preferably, the lines 16 in the sanding pad 10 are spaced about 0.48 centimeter (0.19 inch) apart, each of the slits is about 1.9 centimeters (0.75 inch) long, and the parts of the sheet separating the slits along each of the lines are about 0.33 centimeter (0.13 inch) in length along the lines.

The present invention has now been described with reference to one embodiment thereof. It will be apparent to those skilled in the art that many changes can be made in the embodiment described without departing from the scope of the present invention. For example, the sheet 12 could have slits along only one line that could be generally centrally located on the sheet or along a small number of lines (e.g., 2, 3 or 4) that could be spaced across the sheet. Thus the scope of the present invention should not be limited to the structures described in this application, but only by structures described by the language of the claims and the equivalents of those structures.

I claim:

1. A sanding pad particularly useful for simultaneously sanding intersecting surfaces at a corner, said pad comprising:

a rectangular backing sheet having first and second surfaces and having through slits along closely spaced parallel lines, with said slits along each line forming most of said line and being spaced by a plurality of unslit parts of said sheet;

a coating of abrasive granules adhered along said first surface; and a layer of resiliently compressible foam adhered on and coextensive with the second surface of said backing sheet, said foam having sufficiently low density to afford bending said backing sheet at about a right angle along one of said lines to deform said foam adjacent the line about which said sheet is bent while retaining in generally planar condition the two portions of said sheet on opposite sides of the line about which the sheet is bent.

2. A sanding pad according to claim 1 wherein said lines are spaced at about 0.48 centimeter apart, each of said slits is about 1.9 centimeter long, and said unslit parts of said sheet separating said slits along each of said lines are about 0.33 centimeter in length along said lines.

3. A sanding pad according to claim 1 wherein said backing sheet is of cloth, and said foam is an open cell polyurethane having a density of about 24 kilograms pounds per cubic meter.

4. A sanding pad particularly useful for simultaneously sanding intersecting surfaces at a corner, said pad comprising:

a rectangular backing sheet having first and second surfaces and having through slits along at least one line across said sheet, with said slits along said line forming most of said line and being spaced by a plurality of unslit parts of said sheet;

a coating of abrasive granules adhered along said first surface; and a layer of resiliently compressible foam adhered on and coextensive with the second surface of said backing sheet, said foam having sufficiently low density to afford bending said backing sheet at about a right angle along said line to deform said foam adjacent the line while retaining in generally planar condition the two portions of said sheet on opposite sides of the line about which the sheet is bent.

5. A sanding pad according to claim 4 wherein each of said slits is about 1.9 centimeter long, and said unslit parts of said sheet separating said slits along said lines are about 0.33 centimeter in length along said line.

6. A sanding pad according to claim 4 wherein said backing sheet is of cloth, and said foam is an open cell polyurethane having a density of about 24 kilograms pounds per cubic meter.

* * * * *